United States Patent [19]

Shetley et al.

[11] Patent Number: 5,074,178

[45] Date of Patent: Dec. 24, 1991

[54] APPARATUS AND METHOD FOR CUTTING DRAWINGS FROM A WEB OF SHEET MATERIAL

[75] Inventors: Paddy B. Shetley, Raleigh; Michael L. Carter, Durham; Robert C. Williams, III, Raleigh, all of N.C.

[73] Assignee: CAD Futures Corporation, Morrisville, N.C.

[21] Appl. No.: 519,092

[22] Filed: May 4, 1990

[51] Int. Cl.[5] ..... B26D 5/38; B26D 5/20

[52] U.S. Cl. ..... 83/47; 83/39; 83/371; 83/367; 83/365; 83/364; 83/408

[58] Field of Search ..... 83/364, 365, 367, 371, 83/47, 210, 214, 255, 408, 407, 425.4, 698, 577, 588, 39

[56] References Cited

U.S. PATENT DOCUMENTS

| | | | |
|---|---|---|---|
| 1,511,016 | 10/1924 | Barker | 83/698 |
| 2,214,593 | 9/1940 | Mustin et al. | |
| 2,316,249 | 4/1943 | Johnson | 83/368 |
| 2,538,972 | 1/1951 | Magnani | |
| 3,469,482 | 9/1969 | Leel | 83/367 |
| 3,522,825 | 8/1970 | Wehner | 83/269 |
| 3,717,058 | 2/1973 | McMinn | 83/365 |
| 3,719,114 | 3/1973 | Vischulis | |
| 3,815,458 | 6/1974 | Jirousek | 83/408 |
| 3,848,490 | 11/1974 | Arel | 83/368 |
| 3,869,997 | 3/1975 | German | 83/408 |
| 3,962,940 | 6/1976 | Schleifenbaum et al. | 83/365 |
| 4,094,217 | 6/1978 | Exline | 83/368 |
| 4,163,405 | 8/1979 | Diesch et al. | 83/365 |
| 4,249,437 | 2/1981 | Hagenson | 83/364 |
| 4,327,615 | 5/1982 | Gerber et al. | 83/49 |
| 4,351,208 | 9/1982 | Cobleigh et al. | 83/167 |
| 4,415,978 | 11/1983 | Craemer et al. | 83/364 |
| 4,541,317 | 9/1985 | Van Humbeeck et al. | 83/368 |
| 4,558,615 | 12/1985 | Kuehfuss | 83/367 |
| 4,599,925 | 7/1986 | Rom | 83/698 |
| 4,809,573 | 3/1989 | Welch | 83/371 |
| 4,875,254 | 10/1989 | Rudy et al. | 83/371 |

FOREIGN PATENT DOCUMENTS

| | | | |
|---|---|---|---|
| 20829 | 7/1954 | Fed. Rep. of Germany | 83/407 |
| 3633850 | 3/1988 | Fed. Rep. of Germany | |
| 1186468 | 10/1985 | U.S.S.R. | 83/698 |

OTHER PUBLICATIONS

Brochure "Plots Cut Quickly and Accurately" Plot Cutter From Dahle, Dahle U.S.A., Oxford, CT, pp. PS1–PS12.

*Primary Examiner*—Daniel C. Crane
*Attorney, Agent, or Firm*—Richard S. Faust

[57] ABSTRACT

Disclosed are a method and an apparatus for cutting drawings from a web that has emerged from a computer controlled graphics plotter. The apparatus includes a support for holding the spool of paper from the plotter and a drive means for pulling the paper through the apparatus. Photocells serve as sensors for detecting the presence of the four borders of each drawing. In response to signals generated by the photocells, the transverse borders are cut by a rotary scissor during pauses in the advance of the web. The side or "longitudinal" borders of each drawing are cut by a pair of knives that pierce the paper and cut the borders as the web is being advanced through the apparatus.

18 Claims, 7 Drawing Sheets

APPARATUS AND METHOD FOR CUTTING DRAWINGS FROM A WEB OF SHEET MATERIAL

FIELD OF THE INVENTION

The present invention relates to apparatus and methods for cutting sheet material. More particularly, the invention relates to the cutting of rectangular sections, such as engineering drawings, from a continuous web of sheet material.

BACKGROUND OF THE INVENTION

Computer controlled graphics plotters such as those manufactured by Versatec, Inc. and Hewlett Packard are well known in the art for their ability to generate precise engineering drawings according to data stored in computer files. These plotters typically generate the drawings on a continuous web of sheet material. Following a "run" of drawings it is necessary to cut each individual drawing from the web. The drawings typically contain rectangular "cut borders" that are used as the cut lines.

According to the prior art, the rectangular drawings have been cut from the web by an operator making four manual cuts. In many instances, these cuts have been made utilizing conventional trimming boards of the type having a pivoting cutting arm. Also used have been table trimmers specifically designed of cutting blueprints and tracing paper such as those manufactured by Neolt Company of Italy under Model No. Trim 130. These table trimmers include a horizontal platen for supporting the paper and a manually operated rotary cutter that operates against an edge of the platen for executing each cut. The paper must be initially positioned for the first cut and then manually rotated at least once in order to cut out a single drawing.

While automated techniques exist for cutting items from continuous webs, for example, cutting individual photographs from a web containing hundreds of photographs, there is an acute need for a reliable, automated apparatus and method by which individual engineering drawings may be cut from a continuous web on which the drawings have been made by a computer controlled graphics plotter. Such an apparatus and method should easily interface with the plotter by accepting rolls containing drawings directly from the plotter and should be capable of making neat, clean cuts at least as accurately as those made by hand.

SUMMARY OF THE INVENTION

Broadly stated, the present invention provides an apparatus and method for cutting individual rectangular drawings from a web of sheet material. The web may take the form of a spool of paper containing drawings produced by a computer controlled graphics plotter. Typically these plotters are capable of providing a rectangular cut border around the graphics. The primary purpose of the cut border is to provide the four cut lines that are used when cutting the drawing from the web.

According to the method of the invention, the web is advanced through a scanning and cutting zone while establishing a transverse scan of the web. The leading transverse border of each drawing is detected by the transverse scan in response to which the advance of the web is stopped. While the advance is stopped, the right and left longitudinal borders of the drawing are located and a pair of knives pierce the sheet material, with one knife being in alignment with each respective one of the longitudinal borders. The advance of the web is resumed with the knives remaining in paper-piercing orientation so that they may cut the right and left longitudinal borders as the web advances. The web is stopped for the purpose of executing a transverse cut at the leading border whereupon the advance of the web is thereafter continued so that the cutting of the entire right and left longitudinal borders may be completed by the knives. Finally, the trailing transverse border is detected, and the advance of the web is stopped so that a transverse cut may be made at the trailing border.

The apparatus of the invention includes means for holding and dispensing the web. This means may take the form of a conventional spool mount. Drive means in the form of a pair of rollers is provided for pulling the web through a scanning and cutting zone. A carriage spanning the scanning and cutting zone carries photocells for detecting the borders of the advancing web and also the knives and associated plungers for executing the longitudinal cuts. A transverse web cutter is located "downstream" from the web drive rollers. Signals generated by the photocells and an encoder linked to the web drive are fed to a microprocessor that controls the web feed, longitudinal cuts and transverse cuts.

In certain preferred embodiments of the invention, the knife blades are forwardly offset from the drive center of the plungers to permit the blade to swivel as necessary to provide straight cuts.

The upper and lower web drive rollers may be formed of relatively soft and relatively hard materials, respectively, in order to maintain a substantially constant pulling force across the entire width of the web to facilitate pulling of the web without crinkling, even when the web has been pierced by the knives.

DESCRIPTION OF THE DRAWINGS

Some of the objects having been stated, other objects will appear as the description proceeds, when taken in connection with the accompanying drawings, in which.

DETAILED DESCRIPTION OF THE INVENTION

Figure 1:
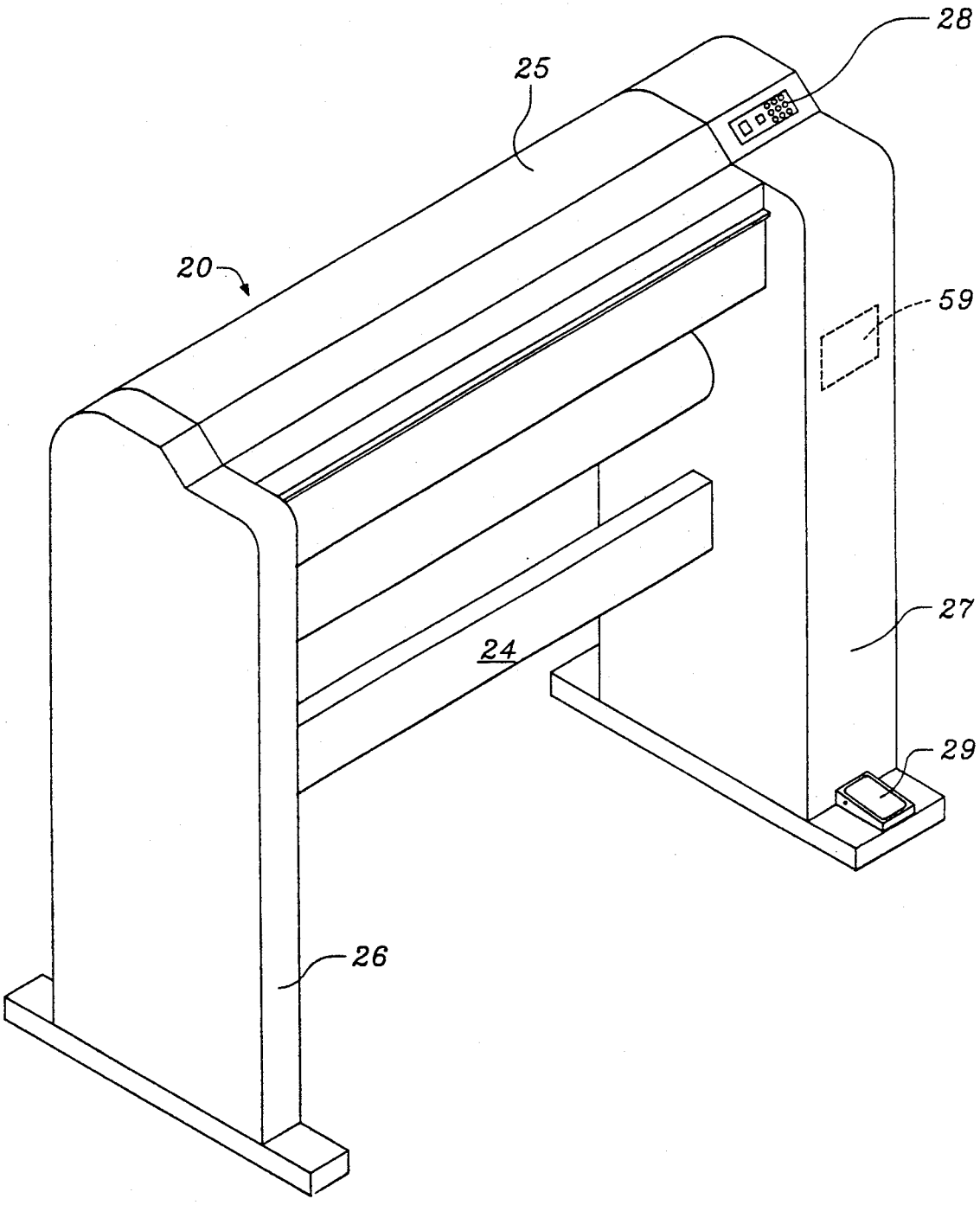
FIG. 1 is a front perspective view of the paper cutting apparatus of the present invention.
Figure 5:
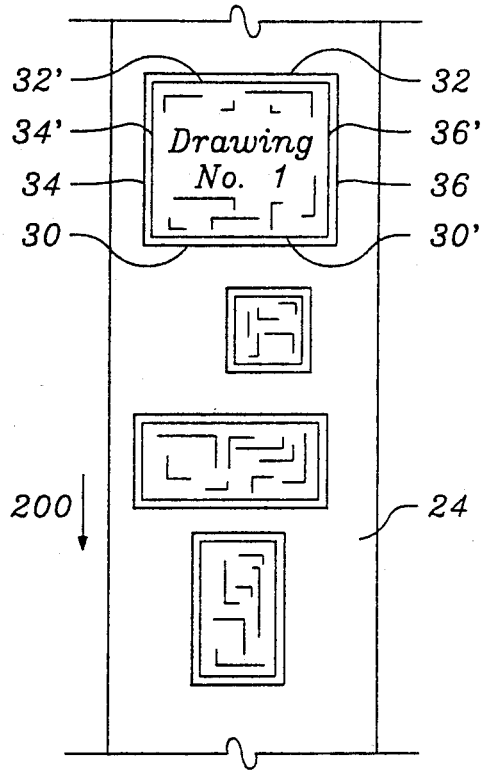
FIG. 5 is a top view of a segment of a web of sheet material from a computer controlled graphics plotter, showing several drawings disposed thereon.

Referring to the drawings, particularly to FIG. 1, there is shown an automatically controlled apparatus 20 constructed in accordance with the present invention. Apparatus 20 includes a hingedly mounted cover 25, a pair of support legs 26, 27, an operator control panel 28, a foot switch 29 and a spool-type mount 23 (FIG. 3) that holds and dispenses a continuous web 24 of sheet material. Web 24 may be directly transferred to apparatus 20 from a computer controlled graphics plotter and contains multiple engineering drawings thereon. The web may be as much as 500 feet in length, typically has a width on the order of 22" to 44" and may contain up to several hundred drawings. The individual drawings contained on the web may vary greatly in size with a typical range of sizes being from 8½" by 11" to 43" by 300". A representative arrangement of drawings on a portion of the web is illustrated in FIG. 5, with the borders which serve a the cut lines for drawing number 1 being identified by the reference numerals 30 32 (transverse borders) and 34, 36 (longitudinal borders). The "drawing borders" 30', 32', 34', 36' will remain after the drawing is cut out.

Figure 2:
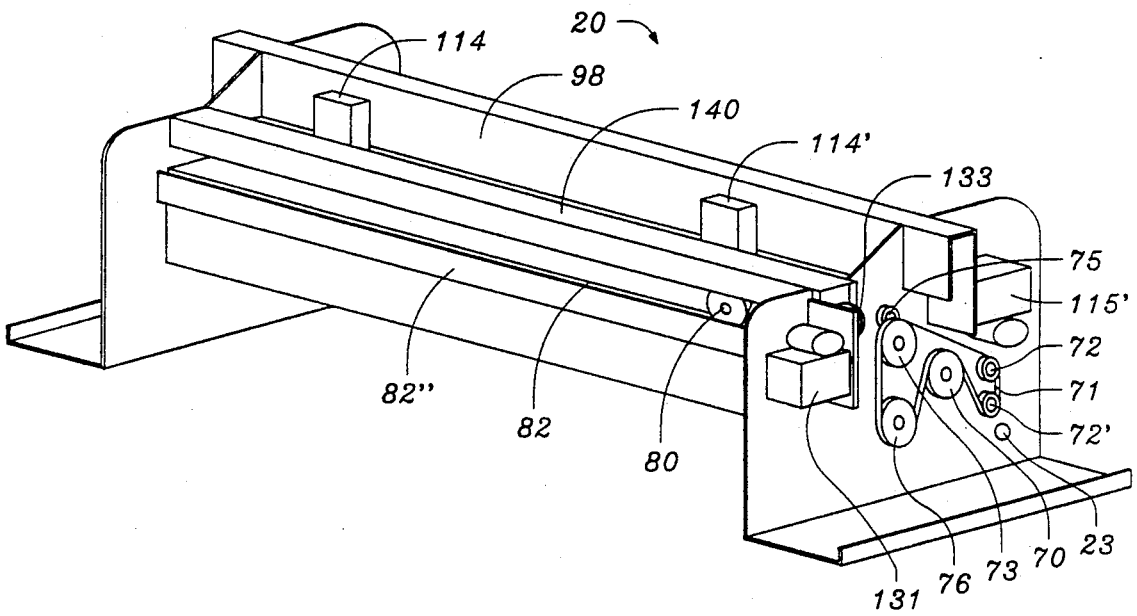
FIG. 2 is a front perspective view of the upper portion of the apparatus, with shrouds and other cover portions removed for purposes of illustration.
Figure 3:
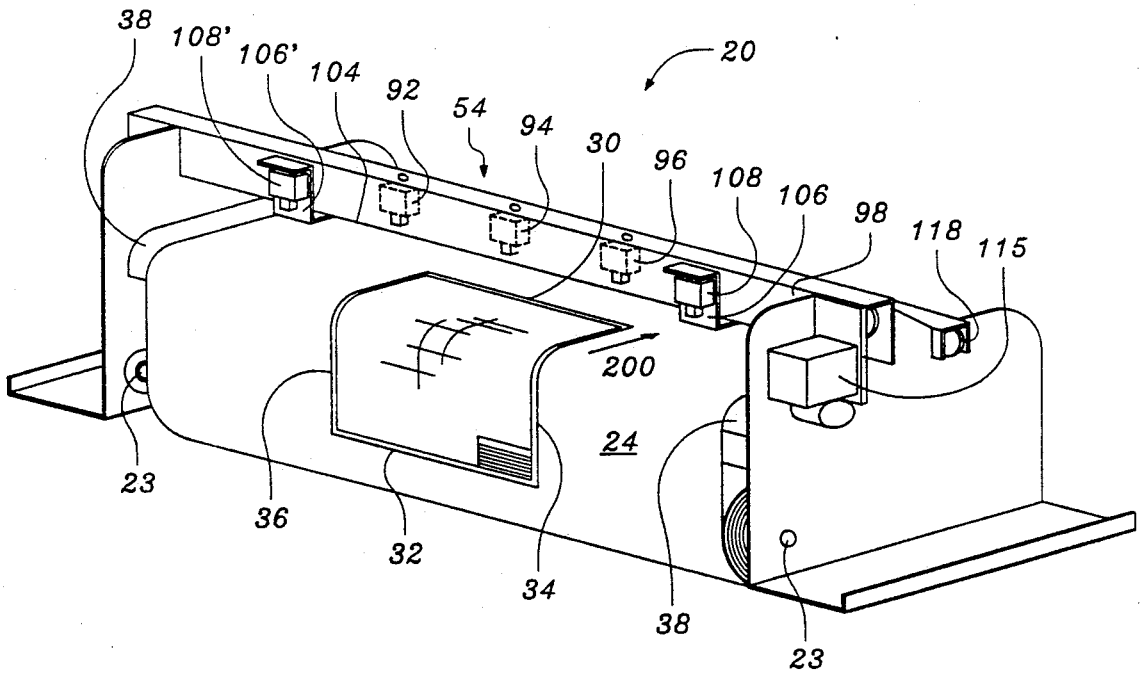
FIG. 3 is a rear perspective view of the upper portion of the apparatus, with shrouds and other cover portions removed for purposes of illustration.
Figure 4:
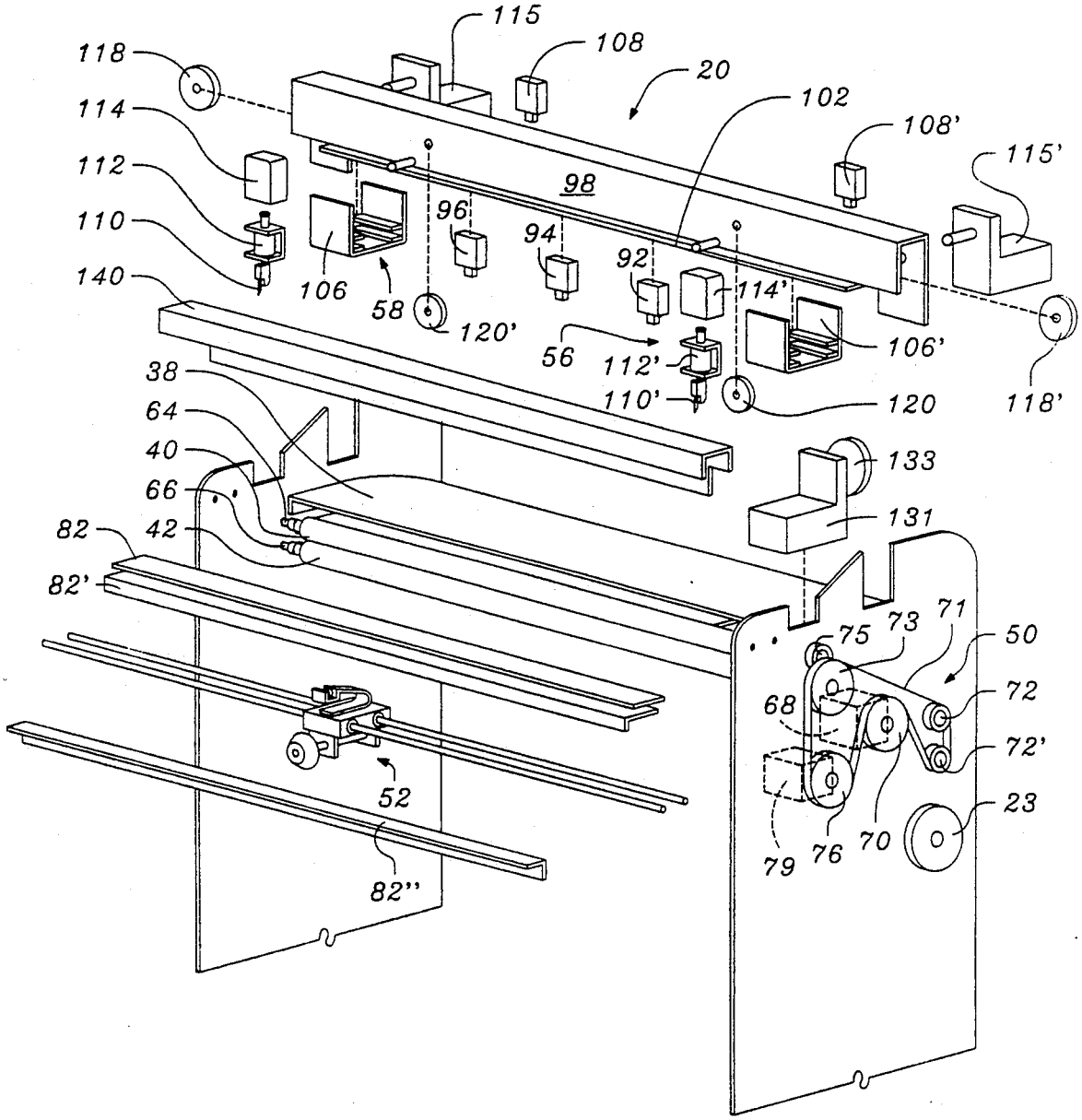
FIG. 4 is an exploded perspective view of the portion of the apparatus shown in FIG. 2.

Referring to FIGS. 2–4, web 24 is threaded through the apparatus from the spool, over a curved guide surface 38, across the upper horizontal portion of the apparatus and through the drive rollers 40, 42 (FIG. 4) which serve to pull the web through the apparatus. The zone from guide surface 38 through drive rollers 40,42 and to the downstream transverse cutter is sometimes referred to herein as the "scanning and cutting zone."

The major portions of the apparatus as seen in FIGS. 1–4 are the paper drive assembly 50, the transverse cutter assembly 52, the transverse optical scanning assembly 54, the right and left longitudinal sensor/knife assemblies 56, 58, and the microprocessor 59. In the most general sense, these components cooperate to drive the web through the apparatus while the right and left longitudinal borders of each drawing thereon are cut by assemblies 56, 58 and the leading and trailing transverse borders are cut by assembly 52.

The paper drive assembly 50 includes the opposed drive rollers 40, 42 which span virtually the entire width of the apparatus. The drive rollers are mounted on shafts 64, 66 respectively which in turn are mounted in side openings in the frame. The rollers are driven by a self-braking, unidirectional motor 68 through a chain and sprocket arrangement best illustrated in FIG. 4. The sprocket arrangement includes a drive sprocket 70 that is directly driven by the drive shaft of motor 68. Chain 71 links drive sprocket 70 to a pair of idler/tensioning sprockets 72, 72' and to sprocket 73 which directly drives lower drive roller 42. A pair of meshed gears 74, 75 serve to drive the upper drive roller 40. The lower gear 74 (not shown) rotates with sprocket 73 and meshes with gear 75 which is secured to the shaft 64 of drive roller 40. Chain 71 also drives a sprocket 76 that is linked to an incremental shaft encoder 79 which, as explained in detail below, functions in conjunction with the microprocessor to start and stop the web drive at those times when transverse cuts are to be made. In the preferred embodiment, the encoder that is used is a product of Dynapar Corporation of Gurnee, Ill., manufactured under ROTOPULSER® Model No. 310100300000, and counts at sixty pulses per revolution.

Because the longitudinal cuts may take place at any point across the width of the web, the web must be continuously pulled across substantially its complete width by rollers 40, 42. To avoid varying pull forces which can cause crinkling of the web, the lower roller 42 is formed from a relatively hard material which applies the primary pulling force, while the upper roller 40 presents a relatively soft material to the web for the purpose of pressing the web tightly against the lower roller. In one preferred embodiment, the lower roller is formed with a relatively hard, unyielding rubber surface having a hardness on the order of about 90 durometer, while the upper roller is covered with a relatively soft, yieldable material having a hardness on the order of about 50 durometer.

Figure 6:
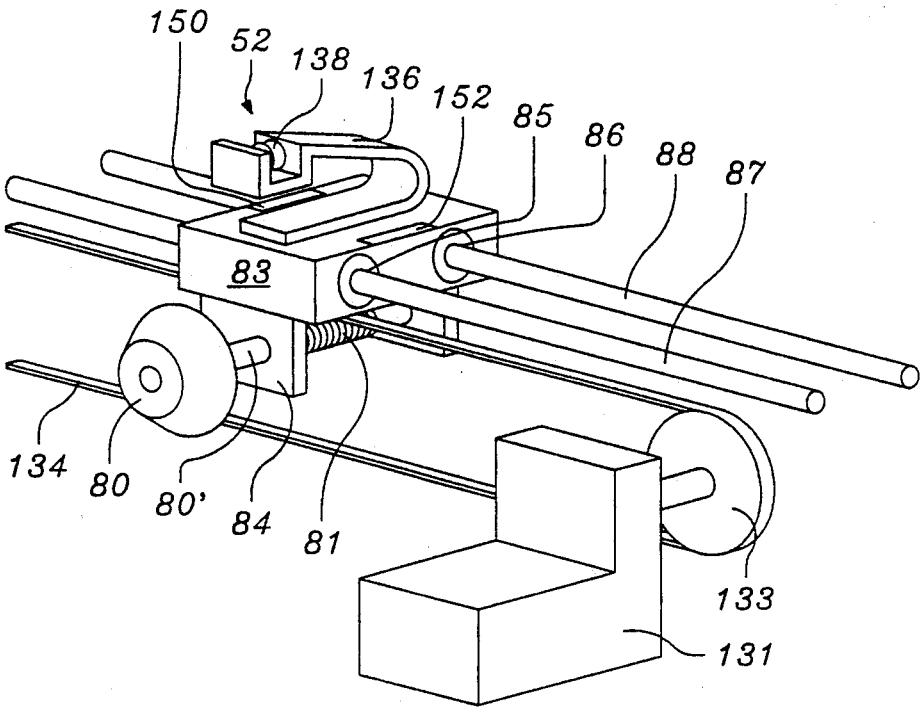
FIG. 6 is a perspective view of the principal components of the transverse cutter assembly that serves to cut along the leading, and trailing borders of each drawing.

The transverse cutter assembly 52 will now be described with primary reference to FIGS. 3, 4 and 6. Assembly 52 includes a rotary cutter, or rotary scissor, 80 which is driven across the paper in contact with a transverse cutting blade 82 to effect a transverse cut immediately downstream of the drive rollers 40, 42. Cutting blade 82 is formed as a relatively flexible, flat plate and is, therefore, reinforced against deflection by an underlying angle member 82' (FIG. 4). Immediately downstream of cutting blade 82 is a cutting shelf 82" (FIGS. 2 and 4) that serves to support the web as the transverse cuts are being made, providing cleaner cuts.

Rotary cutter 80 is mounted on a shaft 80' and is biased by a spring assembly 81. Cutter 80 is secured to a support block 83 by a bracket 84. Support block 83 includes a pair of bearings 85, 86 which receive rails 87, 88. The rails extend across the apparatus. A self-braking, reversible motor 131 powers a sprocket 133 and chain 134 which serve to drive block 83 and rotary cutter 80 across the apparatus. A spring member 136 is provided on the upper surface of support block 83. Member 136 carries a roller 138 that rides in a channel provided in the cutter assembly cover member 140 (FIGS. 2 and 4) which extends across the apparatus above cutting blade 82. The engagement of roller 138 to cover member 140 provides a continuous downward cutting bias to rotary cutter 80 as it traverses the apparatus in cutting relationship to cutting blade 82.

In order to inform the microprocessor when the rotary cutter reaches its limit of travel at the extreme left and right sides of the apparatus, support block 83 carries a pair of magnets 150, 152 which engage with a respective pair of magnetic reed relays (not shown) that are mounted on the frame at the limit positions. The relays send signals to the microprocessor which, in turn, either reverses the direction of motor 131 (at the left limit position) or stops the motor (at the right limit position).

As stated above, the rotary cutter assembly makes two cuts in the operational sequence associated with cutting out a single drawing from the web. The first cut is that of the leading transverse border and the second cut is that of the trailing transverse border, with both cuts being accomplished during a pause in the drive of the web through the apparatus. The cuts are automatically controlled in response to signals generated by the encoder and the various photocells of assemblies 54, 56, 58, all in a manner described in more detail below.

The transverse optical scanning assembly 54 (FIGS. 3 and 4) serves to scan the advancing web in order to detect the leading transverse border of a new drawing entering the scanning and cutting zone. Assembly 54 has been designed to detect solid lines on the order of 0.030 inches to 0.060 inches in width, as are typical for the borders. According to the illustrated embodiment, the transverse scan is achieved by the utilization of three optical sensors 92, 94, 96 which are positioned in line above the scanning and cutting zone and mounted within carriage 98. These photocells may take the form of self-contained, focusing infrared photocells manufactured by Banner Engineering Corporation of Minneapolis, Minn. as model number SM312CVG. In an apparatus designed to receive a web having a width of 36", it has been found that with three photocells spaced as shown in FIG. 3 (one in the middle and the other two at approximately 10" from the middle) at least one photocell will be positioned to detect the leading transverse border of any drawing of normal size passing through the machine.

The right and left longitudinal sensor/knife assemblies 56, 58 are carried above the scanning and cutting zone by carriage 98. Carriage 98 provides flanges 102 and 104 at the lower portion thereof which serve as tracks for permitting the components of assemblies 56, 58 to traverse carriage 98. The description will proceed with a discussion of left assembly 58, with the understanding that right assembly 56 is essentially identical. Components of the right assembly 56 ar designated by the same reference numerals as those of the left assembly, except for the addition of a "prime" indicator.

Left assembly 58 includes a bracket 106 which rides on carriage flanges 102, 104 by means of flange-engaging rollers 105. The rear of bracket 106 mounts an optical sensor 108 which, in the preferred embodiment, is the same type of a self-contained, focusing infrared photocell as discussed above. Photocell 108, when energized, serves to detect borders having a width on the order of 0.030 inches to 0.060 inches.

The front of bracket 106 carries a knife 110, a knife holder 111 and an associated plunger means which, in the preferred embodiment, takes the form of a 115 volt, AC push-type solenoid 112. A protective cover 114 is provided for solenoid 112. Bracket 106 and the components mounted thereon are driven along carriage 98 by means of a self-braking reversible drive motor 115, a chain drive sprocket 118 and a second drive sprocket 120 (shown only in FIG. 4). Sprocket 120 is rotatably mounted within the channel shaped carriage 98 at a point approximately three-fourths of the way across carriage 98 from sprocket 118. The chain (not shown) that drivingly connects sprockets 118 and 120 is secured to bracket 106, thus enabling the bracket, knife 110 and photocell 108 to be independently driven to any point along carriage 98 between the extreme left "home" position of assembly 58 and the position of sprocket 120.

In the illustrated embodiment, the knife holder 111 is utilized to permit quick replacement of knives 110 by use of a thumbscrew 122 which opens and closes a receiving cavity for the knife.

During cuts of the longitudinal borders by knife 110, web 24 must be pierced before cutting can begin. Thus, knife 110 is drive through the web by solenoid 112. The knife does not cut against a platen or roller which would be ultimately scarred or scored by the web. Tension in the web created by rollers 40, 42 and the inertia of the roll of web material allow the piercing through free spans of the web.

Figure 7:
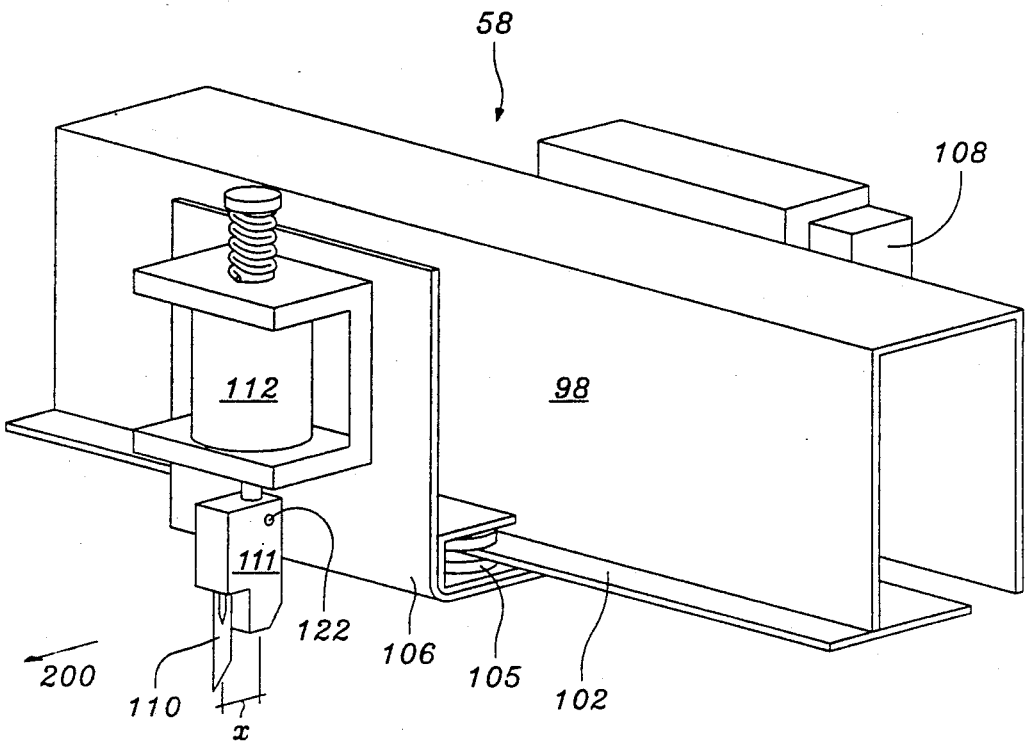
FIG. 7 is a perspective view of the principal components of one of the longitudinal sensor/knife assemblies that are movably mounted on the carriage and serve to cut along the longitudinal borders of the drawings as the web moves through the apparatus.

Referring to FIG. 7, the blade of knife 110 is positioned parallel to but not concentric with the drive center of solenoid 112, thereby permitting the blade to "swivel" so that cutting will freely follow the movement of the web. Stated differently, the knife blade is essentially in longitudinal alignment with the drive center of solenoid 112. However, the blade is displaced forward of the drive center by a small distance X (FIG. 7) which may be on the order of ¼". It has been found that a blade that is not so offset will tend to "wander" and generate a somewhat curving cut. On the other hand, the offset blade is permitted a small degree of rotation or swiveling about the vertical axis of its mount (i.e. about the drive axis of solenoid 112).

The microprocessor 59, in the preferred embodiment, takes the form of a model LS1000 microprocessor manufactured by Minarik Electric Company of Los Angeles, Calif. A description of the microprocessor's function in carrying out the invention will be discussed as the description proceeds.

The operation of apparatus 20 will now be generally described with reference to the schematic sequential drawings of FIGS. 8–12.

Apparatus 20 is energized by the operator's pressing switch 130 (FIG. 13) to the "on" position. The leading edge of web 24 is placed between drive rollers 40, 42, after which the operator depresses foot pedal 29 to adjust and align paper. Next, the operator presses start button 132 to energize the web drive system. The operation becomes automatic at this point.

Figure 8:
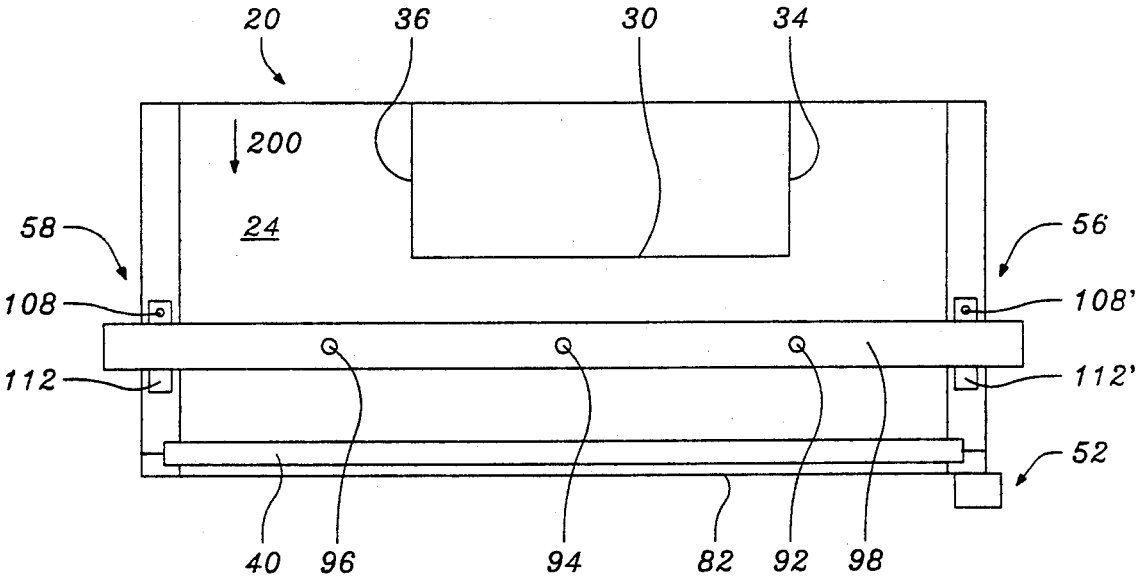
FIGS. 8–12 are schematic top views of the apparatus of the present invention showing the operational sequence associated with cutting out one rectangular drawing from the web.

FIG. 8 illustrates apparatus 20 at at time when a new drawing having borders 30, 32, 34, 36 is advancing in the direction of arrow 200 through the scanning and cutting zone. Photocells 92, 94, 96 establish a transverse scan of the web and await detection of leading transverse border 30. The right and left sensor/knife assemblies 56, 58 are at "home" at their outwardly disposed positions on carriage 98. The rotary scissors of transverse cutter assembly 52 is at its "home" position at the extreme right side of the apparatus.

Figure 9:
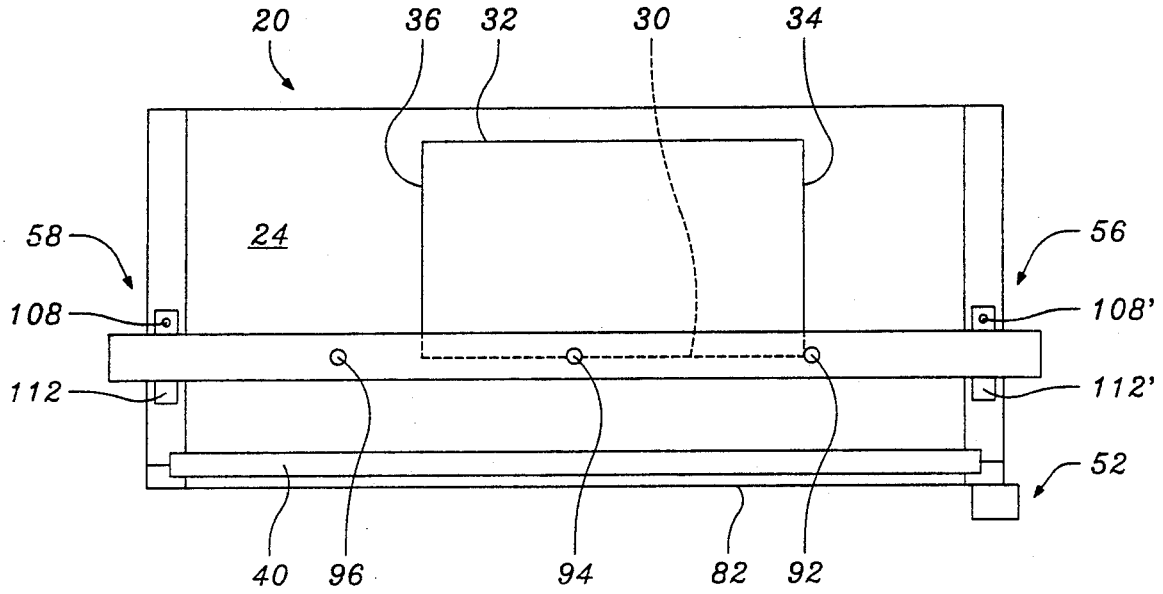
Figure 10:
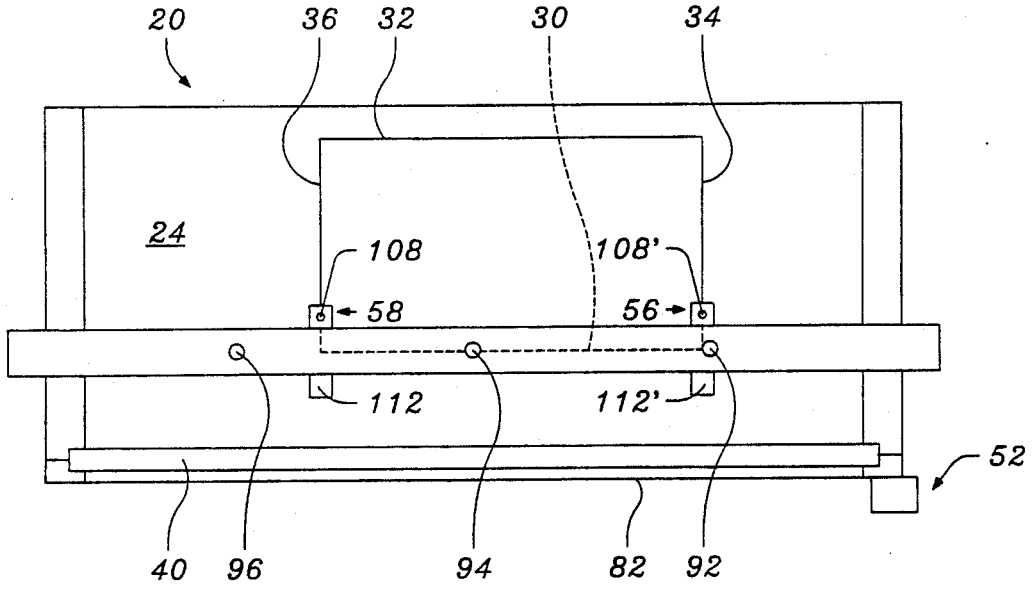

FIG. 9 illustrates the position where at least one of photocells 92, 94, 96 have detected border 30 and generate a signal, in response to which the microprocessor stops drive motor 68, thereby stopping the advance of web 24.

Once web 24 has stopped in the position shown in FIG. 9 the left and right assemblies 58, 56 drive inwardly from their respective home positions until their respective photocells 108, 108' sense the location of longitudinal borders 34, 36. At this time (FIG. 10) the photocells stop over or in close proximity to borders 34, 36, thereby bringing the solenoids 112, 112' and the knives carried thereby substantially into longitudinal alignment with borders 34, 36. (As discussed in more detail below, the "substantial longitudinal alignment" of knives 110, 110' with the longitudinal borders may cover those situations where the longitudinal cuts are made directly on the borders, just inside the borders, or offset outwardly from the borders by a distance of perhaps, ½ inch.) Photocells 108, 108' generate signals in response to which the microprocessor energizes the solenoids 112, 112' causing knives 110, 110' to pierce the web, followed by a resumption of the advance of web 24. During this advance of web 24 the knives 110, 110' remain in paper-piercing orientation so as to cut the right and left borders 34, 36 as the web advances.

Web 24 continues to advance until border 30 directly overlies the edge of cutting blade 82. At this time the advance of the web stops, the encoder 79 having sensed an advance of the web equal to the distance between the transverse scanning line established by photocells 92, 94, 96 and the cutting blade 82.

Figure 11:
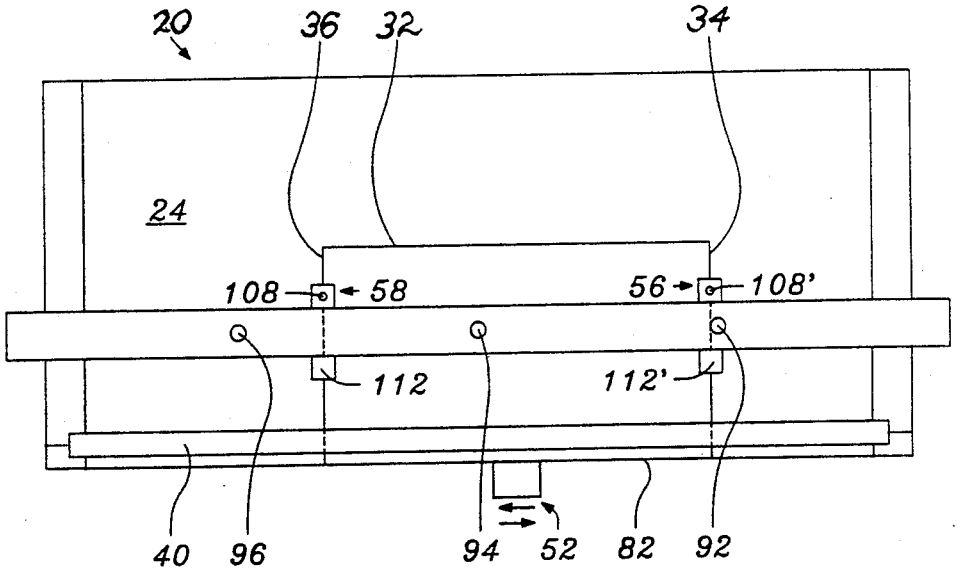

Once the web is stopped in the position shown in FIG. 11, the rotary scissors 80 of the transverse cutter assembly 52 is driven across the full width of apparatus 20 in contact with cutting blade 82 in order to sever the web substantially along border 30. This cutting operation is schematically illustrated in FIG. 11. Preferably, after the cut is achieved the rotary scissor returns to its home position at the extreme right side of the apparatus; however, since the scissors can be adapted to cut in both directions, the processor control may be so established as to provide home positions for the scissors on both the right and left side of the apparatus.

Figure 12:
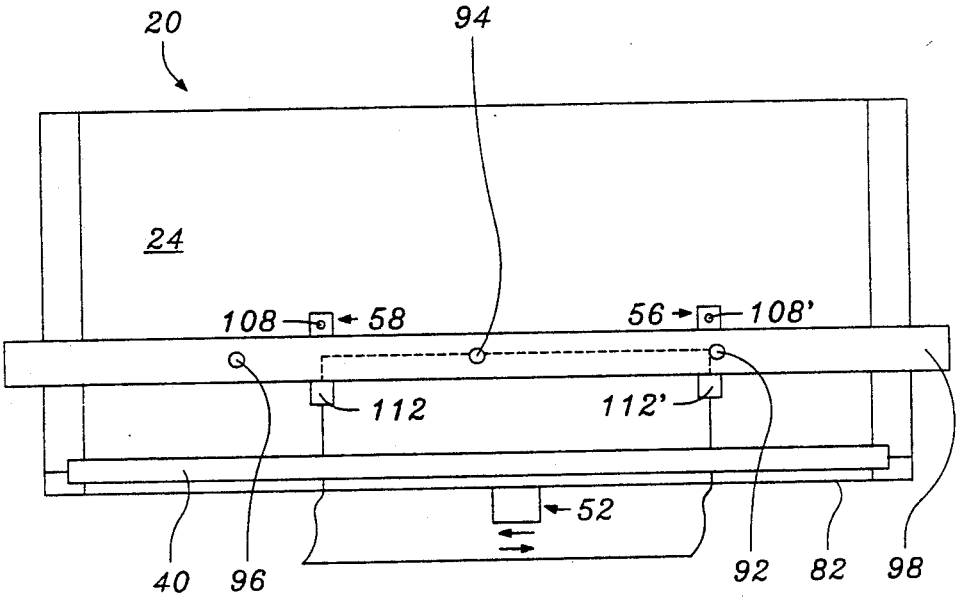

Following the cut along border 30, the advance of web 24 resumes so that knives 110, 110' can complete the cutting of the entire right and left borders 34, 36. As the trailing border 32 crosses under photocells 108, 108' a signal is generated representative of the location of border 32 so that the encoder 79 can begin a new count and stop the web as border 32 overlies cutting blade 82. Referring to FIG. 12, at this time the rotary scissors are driven across the apparatus to cut the web along border 32, thereby completing the four cuts necessary to cut the drawing from the web. Knives 110, 100' may be retracted just before commencement of the transverse cut along border 32.

While a fully automatic operation has been discussed, it will be appreciated that the invention may be carried out with certain of the above functions performed by the operator.

Figure 13:
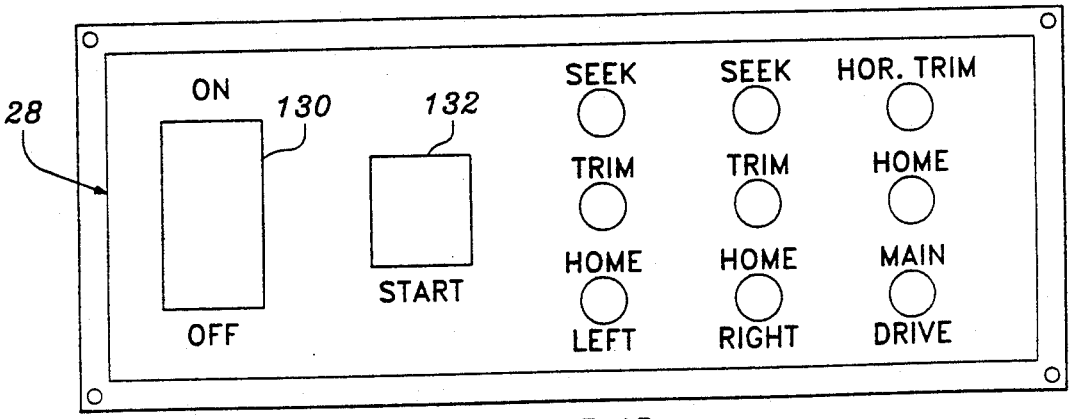
FIG. 13 is a front view of the operator control panel of the apparatus.

The instrument panel illustrated in FIG. 13 includes switches 130 and 13 that have been discussed above and nine indicator lights arranged in three columns. The indicator lights serve primarily to indicate the status of the various drive motors.

While the structure and operation of apparatus 20 have been described in detail above in connection with FIGS. 1–13, a sequencing chart is provided below to further assist in an understanding of the invention:

APPARATUS/MICROPROCESSOR SEQUENCING CHART

| Action | Result |
|---|---|
| 1. Main power on (switch 130). | System energized |
| 2. Load web roll, position paper. | |
| 3. Activate foot switch 29. | Web feeds through rollers, microprocessor inactive. |
| 4. Release foot switch 29. | Feed stops, microprocessor becomes active. |
| 5. Depress start button 132. | Feed restarts. Automatic microprocessor controlled operation begins. |
| 6. Transverse photocells 92, 94, 96 recognize leading border 30. | Feed stops. Longitudinal photocells 108, 108' seek left and right longitudinal borders 34, 36. |
| 7. Left and right borders detected, search discontinued. Photocells 108, 108' drive to points slightly inside borders. | Feed restarts, incremental shaft encoder 79 begins count. Left and right solenoids 112, 112' drive piercing knifes 110, 110' through web for left and right border cuts. |
| 8. Encoder count complete. | Leading border 30 arrives at transverse cutter. Feed stops. |
| 9. Transverse cutter slices web at leading border, returns, signals cut is complete. | Feed restart. |
| 10. Longitudinal photocells 108, 108' detect trailing border 32. | Encoder count restart. |

-continued

APPARATUS/MICROPROCESSOR SEQUENCING CHART

| Action | Result |
|---|---|
| 11. Encoder count complete. | Longitudinal cutting knives retracted. Stop feed. Activate transverse cutter to cut along border 32. Longitudinal photocells sent to "home start" position. |
| 12. Transverse cutter slices web at border 32, returns, signals cut is complete. | Program restarts. Will recycle to next drawing unless timer is activated indicating no new drawing on the web. |

It will be appreciated that drawings may be produced by a plotter without cut borders that are intended to serve as the actual cut lines, as described above. In these situations the drawing borders identified by reference numerals 30', 32', 34', 36' in FIG. 5 would be the first borders "seen" by the photocells. In accordance with the present invention, apparatus 20 may be programed to cut these drawing borders at a predetermined distance outside of the borders, for example, one-half inch outside the border For the transverse cuts, this could be accomplished by simply storing encoder count information that would cause the transverse cuts to be executed one-half inch outside of the drawing borders. In the case of the longitudinal borders, the knives 110, 110' may be offset one-half inch from the photocells, or alternatively, the apparatus 20 may be programmed to cause assemblies 56, 58 to "back off" one-half inch from the detected longitudinal borders to provide the one-half inch offset. Thus, the term "cut along the border" or "cut the border" or similar expressions used herein are intended to cover the situations where the cut is made directly on the detected border, or where the cut is made very slightly inside the detected border, or where the cut is offset from the detected border.

While the invention has been described primarily with reference to cutting multiple drawings from a web of considerable length, it will be appreciated that a web of relatively short length (for example, 18" to 60") may be fed into the apparatus for the purpose of cutting out only one or a few drawings.

While the invention has been described as a free standing unit, it will be appreciated that the principles of the invention apply to an apparatus that may be directly linked to the output of a computer controlled graphics plotter.

In the drawings and specification, there have been disclosed typical preferred embodiments of the invention and, although specific terms are employed, they are used in a generic and descriptive sense only and not for purposes of limitation, the scope of the invention being set forth in the following claims.

That which we claim is:

1. An apparatus for automatically cutting individual rectangular drawings from a web of sheet material as the drawings move along a feed path, and wherein the drawings include leading and trailing transverse borders aligned substantially perpendicular to the feed path and right and left longitudinal borders aligned substantially parallel to the feed path, said apparatus comprising:

means for holding and dispensing a web of sheet material containing individual rectangular drawings thereon;

a scanning and cutting zone located downstream of said means for holding and dispensing;

drive means for pulling the web along a feed path from the holding and dispensing means and through said scanning and cutting zone;

means for detecting the presence of the leading transverse border of a drawing passing through the scanning and cutting zone and generating a signal representative of the detection of the border;

a carriage spanning said scanning and cutting zone, said carriage carrying right and left sensor means for detecting the presence of the respective right and left longitudinal borders of a drawing thereunder and generating signals representative of the locations of said borders;

means for independently positioning said right and left sensor means along said carriage;

right and left piercing and cutting knives, one of said knives being carried in conjunction with each respective one of said right and left sensor means;

right and left plunger means associated with the respective right and left knives for plunging the knives through the web to achieve initial punch holes and to thereafter hold the knives in paper-piercing orientation to achieve cutting of the web as it advances through the scanning and cutting zone;

transverse web cutting means located downstream of said web drive means;

means for controlling operation of the drive means, the independent positioning means for the right and left sensor means, the right and left knife plunger means and the transverse web cutting means as a function of the signals generated by the means for detecting the leading border and the right and left sensor means, to cause the transverse cutting means to cut the leading and trailing transverse borders of the drawing and to cause the right and left knives to pierce the web and thereafter remain in paper-piercing orientation to cut the right and left longitudinal borders while the web advances through the apparatus.

2. The apparatus of claim 1 wherein said means for detecting the leading border comprises photocell means.

3. The apparatus of claim 1 wherein said means for detecting the leading border establishes a transverse optical scan of the advancing web along a line substantially perpendicular to the direction of travel of the web.

4. The apparatus of claim 3 wherein said means for detecting the presence of the leading border comprises multiple photocells carried above the web in alignment along a line substantially perpendicular to the direction of travel of the web.

5. The apparatus of claim 1 wherein said drive means comprises a pair of drive rollers that traverse substantially the entire width of the web being pulled therebetween.

6. The apparatus of claim 5 wherein the drive rollers include a lower drive roller formed of a relatively hard material and an upper drive roller formed of a relatively soft material.

7. The apparatus of claim 6 wherein said upper roller has a hardness on the order of about 50 durometer and the lower roller has a hardness on the order of about 90 durometer.

8. The apparatus of claim 1 wherein each of said right and left sensor means and its respective knife and plunger means are mounted on a common member that travels on said carriage.

9. The apparatus of claim 8 wherein said carriage includes lower flanges on each side thereof and said common member rides thereon.

10. The apparatus of claim 1 wherein said transverse web cutting means comprises a rotary scissor that operates against a cutting edge that spans the width of the apparatus.

11. The apparatus of claim 1 wherein said means for controlling operation of the apparatus includes an encoder linked to said web drive means and a microprocessor that receives the signals representative of the detection of the transverse borders of the drawings passing through the apparatus, said microprocessor storing encoder count information indicative of the distance traveled by the web between the detection of the transverse borders and the transverse web cutting means to permit the drive means to continue advancing the web from the time of the detection of each transverse border until the border reaches the transverse web cutting means and to permit stopping of the web drive means thereat for a time sufficient to cut each transverse border.

12. The apparatus of claim 1 wherein the blade of each knife of said right and left piercing and cutting knives is parallel to but not concentric with the drive center of its respective plunger means.

13. A method of cutting a rectangular drawing from a web of sheet material as the drawing moves along a feed path, and wherein the drawing includes leading and trailing transverse borders aligned substantially perpendicular to the feed path and right and left longitudinal borders aligned substantially parallel to the feed path, said method comprising the following steps:

advancing the web along a feed path through a scanning and cutting zone while establishing a transverse scan of the web;

detecting the leading transverse border of a drawing on the web by the transverse scan;

stopping the advance of the web in response to the detection of the leading transverse border and, while stopped;

locating the right and left longitudinal borders of the drawing; and piercing the sheet material proximate the leading transverse border with a pair of knives, with one knife being located substantially in longitudinal alignment with the right longitudinal border and the second knife being located substantially in longitudinal alignment with the left longitudinal border;

resuming the advance of the web with the pair of knives remaining in paper-piercing orientation so as to cut the right and left longitudinal borders as the web advances;

stopping the advance of the web and, while stopped, executing a transverse cut of the leading transverse border;

resuming the advance of the web and during the advance (i) completing the cutting of the entire right and left longitudinal borders by a pair of knives and (ii) detecting the trailing transverse border; and stopping the advance of the web and, while stopped, executing a transverse cut of the trailing transverse border.

14. The method of claim 13 wherein the step of establishing a transverse scan of the web is achieved by scanning the web with a plurality of photocells positioned above the advancing web along a line substantially perpendicular to the direction of the advance of the web.

15. The method of claim 13 wherein the steps of stopping the advance of the web to cut the leading and trailing transverse borders of the drawings are achieved by computer control that stores count information indicative of the distance between the points of detection of the transverse borders and the position of the downstream transverse cut.

16. The method of claim 13 wherein the cuts of the borders are made at a distance offset outwardly from the borders.

17. An apparatus for cutting a rectangular drawing from a web of sheet material as the drawing moves along a feed path, and wherein the drawing includes leading and trailing transverse borders aligned substantially perpendicular to the feed path and right and left longitudinal borders aligned substantially parallel to the feed path, said apparatus comprising:

a scanning and cutting zone;

drive means for advancing a web of sheet material along a feed path through said scanning and cutting zone;

first sensing means for detecting the leading transverse border of the rectangular drawing as the web advances through the scanning and cutting zone;

means operative in response to the detection of the leading transverse border for stopping the advance of the web;

second sensing means operative during the stopping of the web for locating the right and left longitudinal borders of the drawing and generating signals representative of the locations thereof;

right and left piercing and cutting knives carried above said scanning and cutting zone;

means operative in response to the signals generated by the second sensing means for positioning said knives in longitudinal alignment with the respective right and left longitudinal borders and driving the knives through the paper and thereafter resuming the advance of the web with the knives in paper-piercing orientation to achieve cuts along the full length of each of the right and left borders; and transverse web cutting means for cutting both the leading and trailing transverse borders of the drawing.

18. A method for cutting a rectangular drawing from a web of sheet material as the drawing moves along a feed path, and wherein the drawing includes leading and trailing transverse borders aligned substantially perpendicular to the feed path and right and left longitudinal borders aligned substantially parallel to the feed path, said method comprising the following steps:

advancing the web;

locating the leading transverse border of a drawing on the web;

stopping the advance of the web in response to locating the leading transverse border and, while stopped;

locating the right and left longitudinal borders of the drawing; and piercing the sheet material proximate the leading transverse border with a pair of knives, with one knife being located substantially in longitudinal alignment with the right longitudinal border and the second knife being located substantially in longitudinal alignment with the left longitudinal border;

resuming the advance of the web with the pair of knives remaining in paper-piercing orientation so as to cut the right and left longitudinal borders as the web advances;

stopping the advance of the web and, while stopped, executing a transverse cut of the leading transverse border;

resuming the advance of the web and during the advance (i) completing the cutting of the entire right and left longitudinal borders by the pair of knives and (ii) locating the trailing transverse border; and stopping the advance of the web and, while stopped, executing a transverse cut of the trailing transverse border.

* * * * *